US005201084A

United States Patent [19]

Johnson

[11] Patent Number: 5,201,084

[45] Date of Patent: Apr. 13, 1993

[54] SCREW DRIVEN LIFT MECHANISM FOR A HOSPITAL PATIENT CHAIR TRANSFER SYSTEM

[75] Inventor: Thomas G. Johnson, Blue Hill, Nebr.

[73] Assignee: Dutton-Lainson Company, Hastings, Nebr.

[21] Appl. No.: 765,361

[22] Filed: Sep. 24, 1991

[51] Int. Cl.[5] ..... A61G 7/10

[52] U.S. Cl. ..... 5/81.1; 5/86.1; 5/611; 4/561.1; 4/565.1; 254/102; 254/DIG. 2

[58] Field of Search ..... 5/81.1, 83.1, 85.1, 5/86.1, 87.1, 611; 4/561.1, 564.1, 565.1; 254/98, 102, DIG. 2

[56] References Cited

U.S. PATENT DOCUMENTS

| | | | |
|---|---|---|---|
| 1,282,274 | 10/1918 | Morozowicz et al. . | |
| 1,846,548 | 2/1932 | Ganoung et al. . | |
| 2,673,987 | 4/1954 | Upshaw et al. | 5/86.1 |
| 2,681,455 | 6/1954 | Schwartz | 5/86.1 |
| 2,725,093 | 11/1955 | Saelen | 5/81.1 |
| 2,899,694 | 8/1959 | Horowitz . | |
| 3,220,575 | 11/1965 | Batty et al. . | |
| 3,380,085 | 4/1968 | Ferneau et al. | 5/86.1 |
| 3,732,584 | 5/1973 | James | 5/81.1 |
| 3,790,974 | 2/1974 | Johansson | 5/86.1 |
| 3,829,916 | 8/1974 | James | 5/86.1 |
| 3,866,250 | 2/1975 | Bradford | 297/364 |
| 3,940,808 | 3/1976 | Petrini | 5/86.1 |
| 3,966,632 | 12/1976 | Baker nee viel | 5/83.1 |
| 3,981,484 | 9/1976 | James | 5/81.1 |
| 4,193,147 | 3/1980 | Fischer | 5/81.1 |
| 4,255,823 | 3/1981 | Boyer et al. | 5/81.1 |
| 4,432,359 | 2/1984 | James | 5/81.1 |
| 4,484,366 | 11/1984 | Koontz | 5/81.1 |
| 5,103,509 | 4/1992 | Richards | 4/564.1 |

FOREIGN PATENT DOCUMENTS

| | | | |
|---|---|---|---|
| 2206007 | 1/1980 | Fed. Rep. of Germany | 4/561.1 |
| 2196247 | 4/1988 | United Kingdom | 4/564.1 |

*Primary Examiner*—Alexander Grosz
*Attorney, Agent, or Firm*—Allegretti & Witcoff, Ltd.

[57] ABSTRACT

An improved transfer system for patients is incorporated either with a tub enclosure or a mobile frame and includes telescoping tubes for lifting a patient chair and thus elevating the patient and lowering the patient into the tube enclousre. The lift system incorporates an improved coupling assembly for coupling the actuator for telescoping the inner tube within the fixed outer tube of the assembly.

7 Claims, 3 Drawing Sheets

39
26
28
80

SCREW DRIVEN LIFT MECHANISM FOR A HOSPITAL PATIENT CHAIR TRANSFER SYSTEM

BACKGROUND OF THE INVENTION

This invention relates to an improved transfer system for transferring a patient from a hospital chair or stretcher, for example, into or out of a tub enclosure. More specifically, this invention relates to the lift mechanism associated with such a transfer system.

Vanderheiden in application Ser. No. 07/489,489 now abandoned discloses a patient transfer system which includes a lift mechanism for transporting a hospital patient chair into or out of a tub enclosure. The lift system may be incorporated with the frame for the tub enclosure. Alternatively, the lift mechanism may be associated with the frame of a mobile patient carrier. In each system environment, the lift mechanism includes hollow, concentric, telescoping tubes or posts with a block support at the top end of the inner tube for cooperatively engaging and supporting a patient chair. The inner tube thus supports the patient chair and may be telescoped or raised to thereby raise the patient chair over the edge of a tub and then lower the chair and patient into the tub.

The inner tube or post is moved up and down or telescopes within the fixed outer tube or post by means of a screw actuator. The connection of the screw actuator to the inner tube and the arrangement of bushings between the inner and outer tubes, though workable in the mechanism of the type disclosed by Vanderheiden presents some difficulties, for example, during repair or assembly of the lift mechanism. This results in higher expense for repair and replacement of worn parts, and with respect to lubricating and servicing the mechanism. Thus, there is a need for an improved coupling construction for attaching the screw actuator for the lift mechanism to the telescoping inner tube and for positioning the telescoping inner tube slidably within the fixed outer tube.

SUMMARY OF THE INVENTION

In a principal aspect, the present invention comprises a transfer system which is incorporated or supported by a frame. The system includes a telescoping lift post assembly or mechanism supported by the frame. The post assembly has a hollow inner tube which is telescopically mounted within a fixed, hollow outer tube attached to the frame. A screw actuator is journaled into the frame at one end of the outer tube and is driven by a motor. The actuator projects axially in the outer tube. The opposite end of the screw actuator is connected to a nut which is coupled to the hollow inner tube. The specific improvement in this combination of elements relates to the coupling assembly for coupling the screw actuator to the inner tube through the nut. The construction provides for simultaneously coupling of the nut to the inner tube and also defines a bearing for the inner tube within the outer tube. Thus, the nut has a shape congruent with the inner surface of the inner tube. At least, one pin fits through a passage or through bore in the inner tube and into the nut for attaching the nut to the inner tube. An annular bearing member fits concentrically over the inner tube and retains the pin in position coupling the inner tube and the nut. The bearing is retained in position on the surface of the inner tube for sliding movement therewith by means of lock washers or lock rings. An added feature of the invention is provision of appropriately positioned throughbores in the outer tube and the nut to facilitate lubrication of the nut as it cooperates with the screw actuator. The improved lift mechanism of the invention is useful in combination with or as part of a lift mechanism associated with a tub enclosure as well as a lift mechanism associated with a mobile patient carrier.

Thus, it is an object of the invention to provide an improved lift assembly for a transfer system for patients.

It is a further object of the invention to provide an improved lift assembly comprised of a telescoping inner tube within a fixed outer tube wherein the inner tube is driven by a screw actuator and a coupling system facilitates attachment of the screw actuator to the inner tube and further facilitates slidable movement of the inner tube within the outer tube. A further object of the invention is to provide an improved coupling system for a lift system comprised of telescoping tube members which is economical to manufacture, easy to service, easy to repair, and which is highly reliable.

These and other objects, advantages, and features of the invention will be set forth in the detailed description which follows.

BRIEF DESCRIPTION OF THE DRAWING

In the detailed description which follows, reference will be made to the drawing comprised of the following FIGURES.

DESCRIPTION OF THE PREFERRED EMBODIMENT

Figure 1:
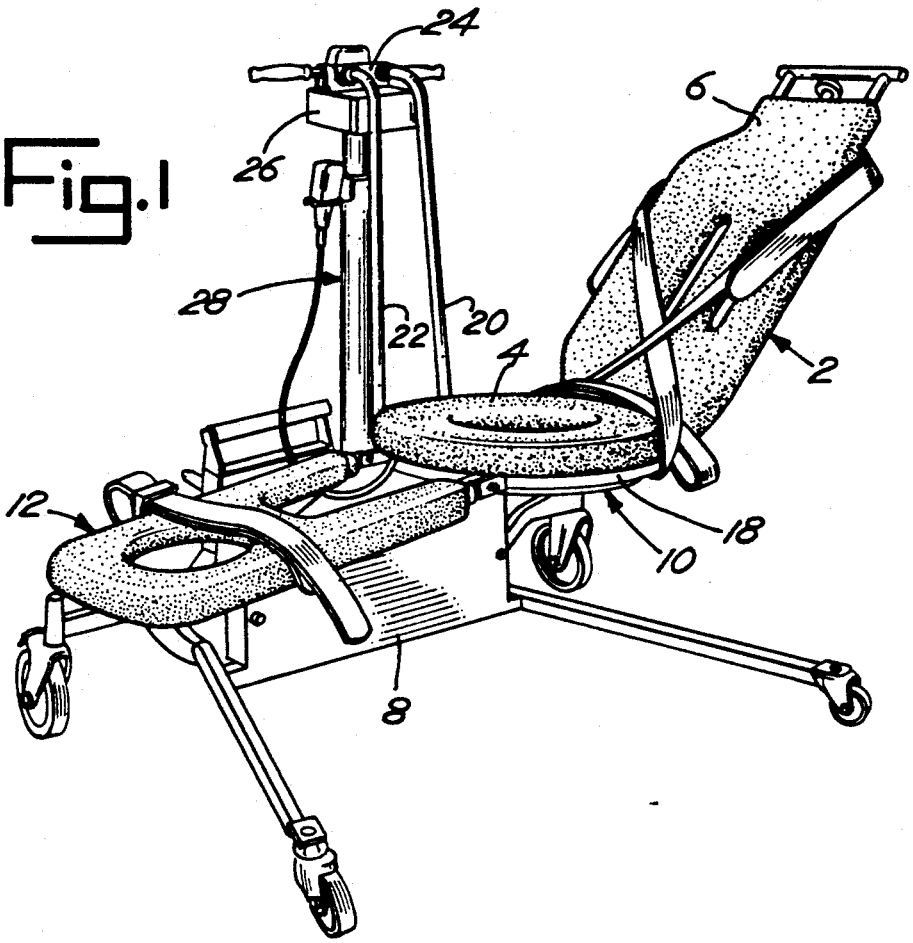
FIG. 1 is a perspective view of the lift mechanism as incorporated in a mobile frame.

Referring first to FIG. 1, there is illustrated a perspective view of the lift mechanism as incorporated in a mobile frame system. The system includes a chair 2 which comprises a seat 4 with an attached back 6. The chair 2 is shown positioned on a moveable platform 8 for transport of the patient to another station. The seat 4 is supported by an attached frame assembly 10. A leg support frame 12 is attached to the seat 4. The assembly 10, in the embodiment depicted, includes a first horizontal support bar 18 which is connected to spaced vertical support bars 20 and 22. The vertical support bars 20 and 22 are connected by a horizontal top cross member 24. The cross member 24 is supported or retained on block 26. The block 26 is constructed to insure that the cross member 24 will remain fixed on the top end of the telescoping lift post assembly 28.

Figure 4:
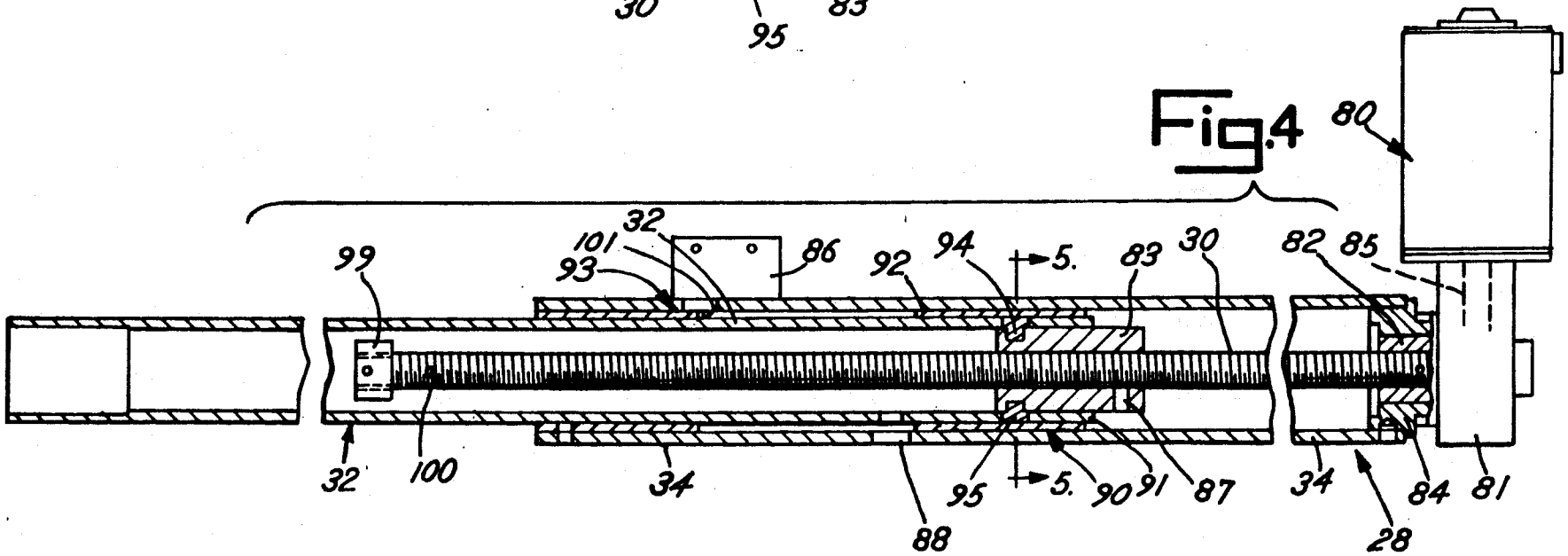
FIG. 4 is an elevation cross-section of the telescoping tube and other components forming the lift construction of the invention.

The invention relates particularly to the combination and construction of the telescoping lift post assembly 28. As depicted in FIG. 4, the assembly 28 comprises a screw actuator or threaded shaft 30 concentrically mounted within a hollow telescoping inner tube 34. The lift assembly 28 works in association with a support block 26, depicted in FIG. 1, affixed to the top end of the inner tube 32 for cooperatively engaging and supporting a patient chair via bars 20, 22, 24.

Figure 2:
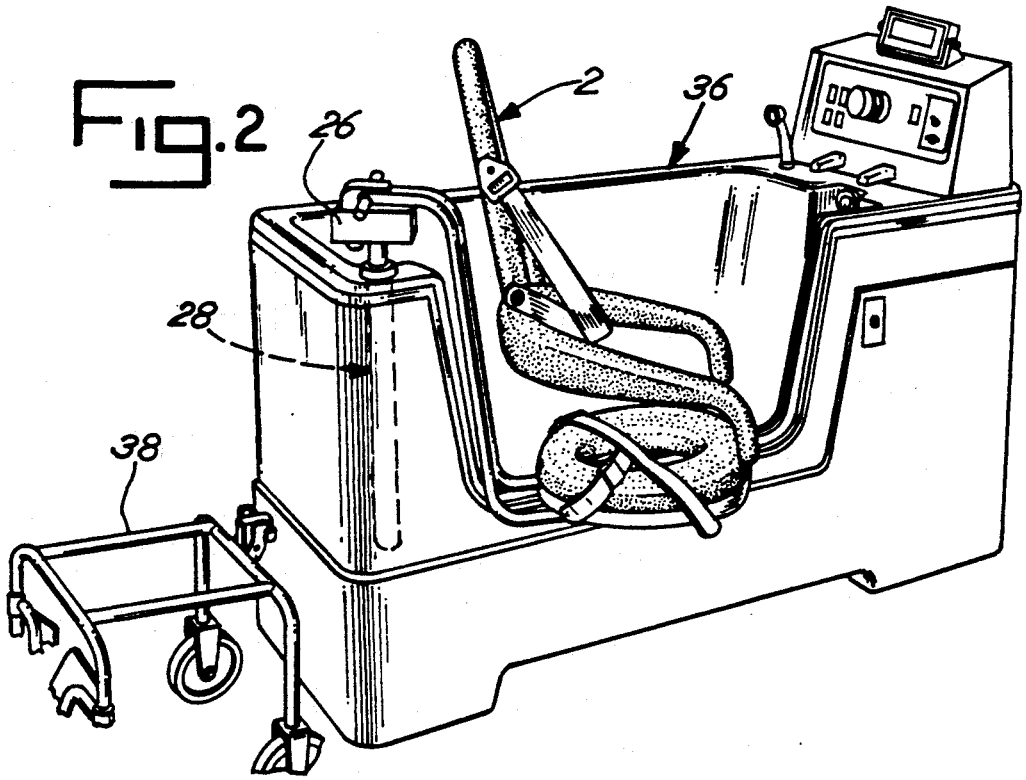
FIG. 2 is a perspective view of a lift assembly as incorporated with a tub frame and enclosure.

In FIG. 2 the chair 2 is shown in combination with a bathing vessel or tub enclosure 36. The chair 2 is attached to and supported by the support block 26 which is mounted on the vertical telescoping lift post assembly 28. The block 26 is constructed to insure that the cross member 24 will remain fixed on the end of post assembly 28. The post assembly 28, which is depicted by phantom lines in a lowered position, is supported by a tub enclosure frame along the side of the tub 36. The chair 2 may be raised or lowered, into and out of the tub, by operation of the post assembly 28. The post assembly 28 is both pivotable and extendable. Thus, the chair 2 may be pivoted from a position entirely within the tub 36 to a position outside the tub 36, as shown in FIG. 2, whereby the chair 2 may be positioned on a moveable platform 38 for transport of the patient to another station.

Figure 3:
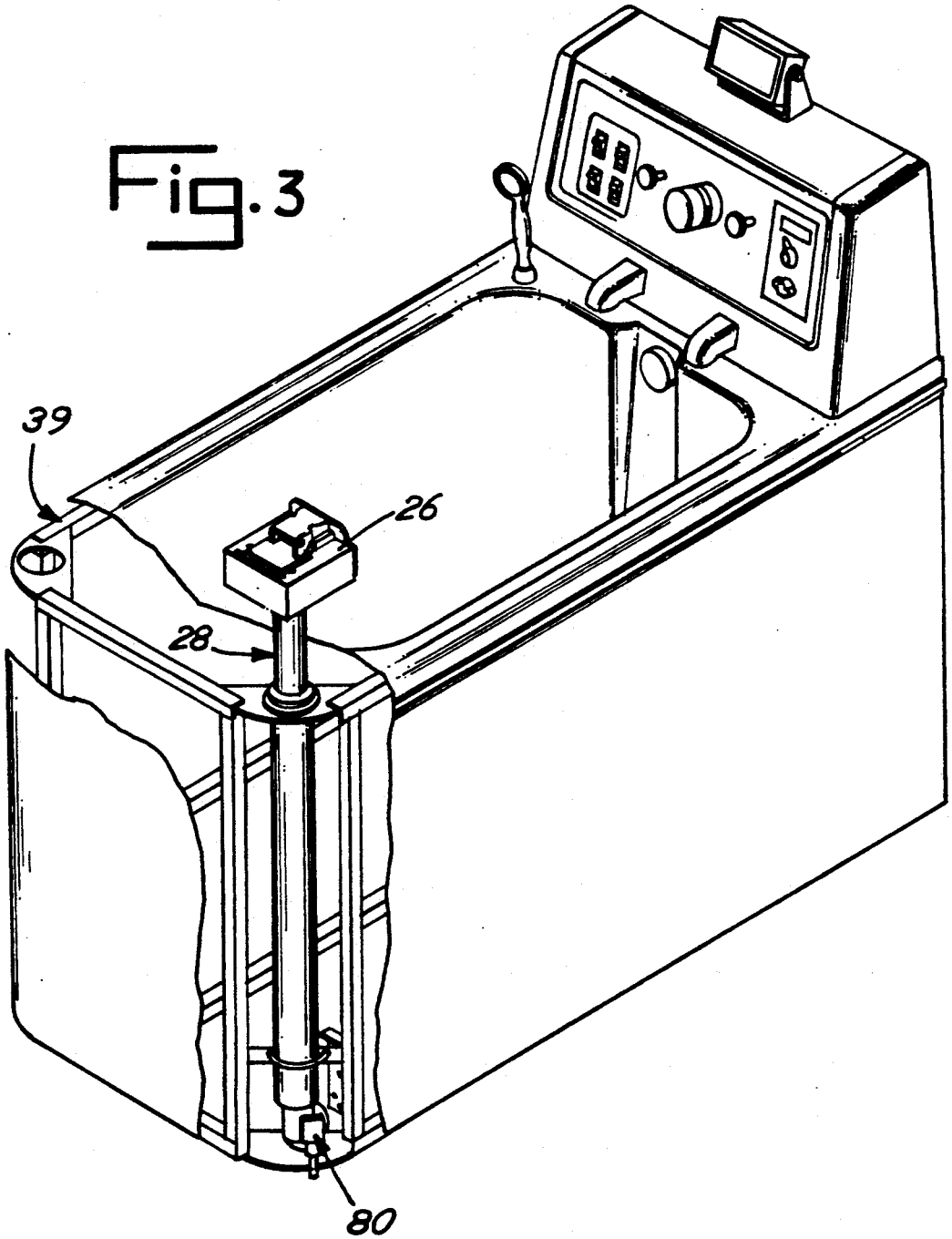
FIG. 3 is a perspective view of the lift assembly of the invention incorporated with the frame of the tub enclosure of the type shown in FIG. 2.

FIG. 3 depicts the chassis for the tub enclosure wherein the lift assembly 28 is incorporated with a tub frame 39. The outer tube 34 is fixed to the frame 39 by conventional clamping means which allow vertical height adjustment. An electric motor 80 is also supported and mounted on the frame 39 with a drive shaft for driving the vertical threaded shaft 30. Mounted on the top of the lift assembly 28 is the block 26.

FIG. 4 is a cross sectional elevation view of the lift assembly 28. As previously described, the outer tube 34 is rigidly mounted either on a mobile carrier or on the frame associated with the tub enclosure. A motor 80 is mounted with an output shaft 85 depicted in phantom lines that drives gears within a gear box 81. A driving gear in the gear box 81 receives the lower end of the shaft 30 thus driving the threaded shaft 30 in the clockwise or counterclockwise direction depending upon whether the shaft is being driven to raise or lower the inner tube 32.

Figure 5:
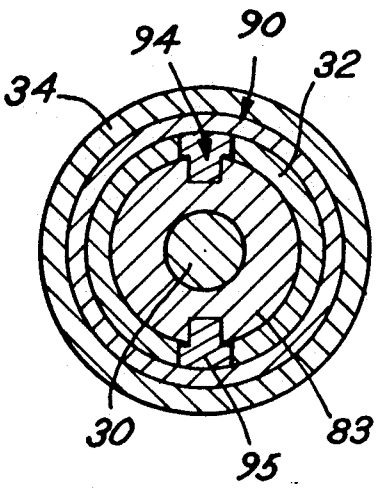
FIG. 5 is a cross-sectional view of the construction of FIG. 4 taken generally along the line 5—5 of FIG. 4.

The shaft 30 is journaled in a bushing 82 which is retained by an annular coupling ring 84 attached to the outer tube 34. The threaded shaft 30 threadably engages a nut 83. The nut 83, threaded shaft 30, inner tube 32, and outer tube 34 are all coaxial as illustrated in FIG. 5. The nut 83 has a throughbore which includes thread means that cooperate with the threaded shaft 30. The outside surface of the nut 83 is generally congruent with the inside of the inner tube 32. The nut 83 includes two radially inward extending counterbores which receive respectively pins 94 and 95 that pass through passages or openings in the inner tube to thereby lock the inner tube 32 to the nut 83. The pins 94 and 95 are retained in position by means of a sleeve 90 which is held in position by locking rings 91 and 92. The sleeve 90 is generally cylindrical in shape and serves the dual purpose of retaining the pins 94 and 95 in position and of serving as a bushing between the inner tube 32 and outer tube 34. As the shaft 30 is rotated then the nut 83 effectively moves upward or downward along the axial direction of the shaft carrying with it the inner tube 32, the pins 94 and 95 and the bushing or sleeve 90.

A second permanently positioned sleeve 93 is affixed at the upper end of the outer tube 34. Lubrication port 88 extends through the outer tube 34. A lubrication port 87 is defined in the wall of the nut 83. When the ports 87 and 88 are aligned it is possible to inject lubricating fluid directly into the nut 83 and consequently, onto the threads of the threaded shaft 30. In the preferred embodiment, the nut 83 is a ball bearing nut containing a series of balls which comprise thread means and roll along the thread of shaft 30.

The upper end of the threaded shaft terminates with a plastic cap member 99 which prevents the upper end of shaft 30 from beginning to whip and bump the inside of tube 32 creating undesirable noise. A cross pin 100 projecting through shaft 30 serves as a physical stop or limit to upward travel of nut 83. The balls associated with nut 83 will thus merely slide or slip when travel of nut 83 is prevented by cross pin 100. Bracket 86 supports a limit switch with an actuator arm 101. Arm 101 is tripped or actuated by interaction with sleeve 90 upon upward travel thereof causing power to motor 80 to be terminated. In operation then, the motor 80, which is a reversing motor, will operate in a clockwise or counter clockwise direction to transport the nut 83 along the shaft 30 and thereby transport the inner tube 32 and telescope the inner tube 32 in the axial direction.

It should be noted that the orientation of pins 94, 95 and the tolerances of the sliding or telescoping parts including tube 32, tube 34 and sleeve 90 are important to the proper operation of the described embodiment of the invention. Thus, there is a small amount of clearance or play between the identified concentric parts. Further, the pins 94, 95 are aligned 180° from each other and thus define an axis along the line 5—5 in FIG. 4. This axis is specifically related to the construction of block 26 which supports the patient chair 2. That is, the axis defined by pins 94, 95 is generally perpendicular to the force vector resulting from weight being supported eccentrically by the tube 32 on block 26. Because of this described geometrical relationship and the tolerances previously mentioned, a certain amount of flexing of the extended inner tube 32 is permitted and desired without binding of the nut 83. Thus, only two pins 94, 95 are highly preferred in the practice of the invention, and the two pins 94, 95 should be oriented in the manner discussed.

The construction of the invention provides a simplified method of assembly and attachment of the nut 83 to the inner tube 32 which is easily serviced, repaired and replaced. Certain modifications maybe made to the described construction. Thus, while there has been set forth a preferred embodiment of the invention it is to be understood that the invention is limited only by the following claims and their equivalents.

What is claimed is:

1. In a patient transfer system of the type including a frame, a telescoping lift post supported by the frame, said post including a hollow inner tube telescopically mounted within a hollow outer tube, said outer tube supported by the frame and having a top and, a screw actuator connected to the inner tube for vertically translating the inner tube relative to the outer tube, motor means for driving the screw actuator, said inner tube including a support block assembly at its top end for support of a patient transport chair or the like, said inner tube rotatable about a vertical axis for horizontal transport of patient chair or the like supported on the support block; the improvement comprising:

an improved coupling assembly for coupling the actuator to the inner tube and for simultaneously providing a bearing for the inner tube within the outer tube, said coupling assembly including a nut on the actuator, said nut having thread passage means for receipt of the screw actuator, said nut being slidably positioned within the hollow inner tube and generally congruent with the inner tube, said nut being attached to the inner tube by at least one pin projecting through a through passage in the wall of the inner tube into the nut; said pin being retained in the through passage and nut by a circumferential bushing around the inner tube which slidably engages the inner surface of the hollow outer tube, and retaining means for holding the bushing on the inner tube for movement therewith as the actuator is driven.

2. The improvement of claim 1 wherein the screw actuator extends through the nut and further including stop means adjacent the top end of the screw actuator, a second bushing interposed between the inner tube and outer tube adjacent the top end of the outer tube, and said screw actuator being journaled at its lower end for support within the inner tube.

3. The improvement of claim 1 including a throughbore in the hollow outer tube and a throughbore in the nut alignable with the throughbore in the outer tube during travel of the inner tube within the outer tube for lubrication access to the screw actuator and nut.

4. The improvement of claim 1 including first and second opposed pins projecting through a through passage in the inner tube into the nut.

5. The improvement of claim 4 further including means for aligning the force vector arising due to the weight supported by the inner tube generally perpendicular to an axis defined by the two pins.

6. The improvement of claim 1 wherein the nut comprises a ball bearing nut.

7. The improvement of claim 6 including stop means projecting from the shaft adjacent the top end of the threaded shaft to limit movement of the nut.

* * * * *